US008328534B2

(12) United States Patent
Zamudio et al.

(10) Patent No.: US 8,328,534 B2
(45) Date of Patent: Dec. 11, 2012

(54) DEFORMED SHELL FOR HOLDING MOTOR STATOR IN A COMPRESSOR SHELL

(75) Inventors: Carlos Zamudio, Lyons (FR); Tracy L. Milliff, Arkadelphia, AR (US)

(73) Assignee: Danfoss Scroll Technologies, LLC, Arkadelphia, AR (US)

( * ) Notice: Subject to any disclaimer, the term of this patent is extended or adjusted under 35 U.S.C. 154(b) by 365 days.

(21) Appl. No.: 12/633,831

(22) Filed: Dec. 9, 2009

(65) Prior Publication Data

US 2011/0135517 A1 Jun. 9, 2011

(51) Int. Cl.
*F04B 39/02* (2006.01)

(52) U.S. Cl. ..... 417/372; 417/366; 417/902

(58) Field of Classification Search ..... 417/366, 417/372, 410.5, 902
See application file for complete search history.

(56) References Cited

U.S. PATENT DOCUMENTS 4,995,792 A * 2/1991 Brown et al. ..... 417/366
* cited by examiner

*Primary Examiner* — Charles Freay
*Assistant Examiner* — Patrick Hamo
(74) *Attorney, Agent, or Firm* — Carlson, Gaskey & Olds, PC

(57) ABSTRACT

A sealed compressor includes a cylindrical shell extending along an axis. A compressor pump unit is mounted within a housing defined by the cylindrical shell. An electric motor has an inner rotor and an outer stator. The stator has an outer peripheral surface of a first dimension. The center shell has a nominal inner diameter, greater than the first dimension of the stator. The rotor drives a driveshaft about the axis. The driveshaft is associated with the compressor pump unit. A suction port extends through the center shell to deliver a suction fluid to be compressed by the compressor pump unit. Some of the suction fluid flows into a gap defined between the nominal inner diameter of the center shell and the outer periphery of the stator. The center shell has portions deformed radially inwardly to contact the outer periphery of the stator.

8 Claims, 2 Drawing Sheets

DEFORMED SHELL FOR HOLDING MOTOR STATOR IN A COMPRESSOR SHELL

BACKGROUND OF THE INVENTION

This application relates to a way to hold a smaller diameter electric motor in a larger diameter sealed compressor center shell, wherein the center shell is deformed to contact an outer periphery of the motor stator.

Sealed compressors are known, and typically include a center shell housing an electric motor and a compressor pump unit. End caps are attached to each end of the center shell. The center shell is cylindrical, and the electric motor has a cylindrical outer diameter stator which is force-fit or otherwise secured within the center shell.

For compressors with higher capacity for a given motor diameter, it is often typical for the compressor pump unit to become of a larger diameter than is required by the motor. Thus, the center shell must also have a larger inner diameter to accommodate the compressor pump unit.

It is not necessary to utilize a larger diameter motor, as the existing motors are typically of sufficient power to power the larger compressor pump units. Thus, some method of securing the electric motor within the center shell becomes necessary.

It has been proposed in the prior art to utilize a cylindrical ring spacer between an outer periphery of the motor stator and the inner periphery of the cylindrical shell. However, this cylindrical ring would raise challenges for assembly.

SUMMARY OF THE INVENTION

A sealed compressor includes a cylindrical shell extending along an axis. A compressor pump unit is mounted within a housing defined by the cylindrical shell. An electric motor has an inner rotor and an outer stator. The stator has an outer peripheral surface of a first dimension. The center shell has a nominal inner diameter, greater than the first dimension of the stator. The rotor drives a driveshaft about the axis. The driveshaft is associated with the compressor pump unit. A suction port extends through the center shell to deliver a suction fluid to be compressed by the compressor pump unit. Some of the suction fluid flows into a gap defined between the nominal inner diameter of the center shell and the outer periphery of the stator. The center shell has portions deformed radially inwardly to contact the outer periphery of the stator.

These and other features of the present invention can be best understood from the following specification and drawings, the following of which is a brief description.

DETAILED DESCRIPTION OF THE PREFERRED EMBODIMENT

Figure 1:
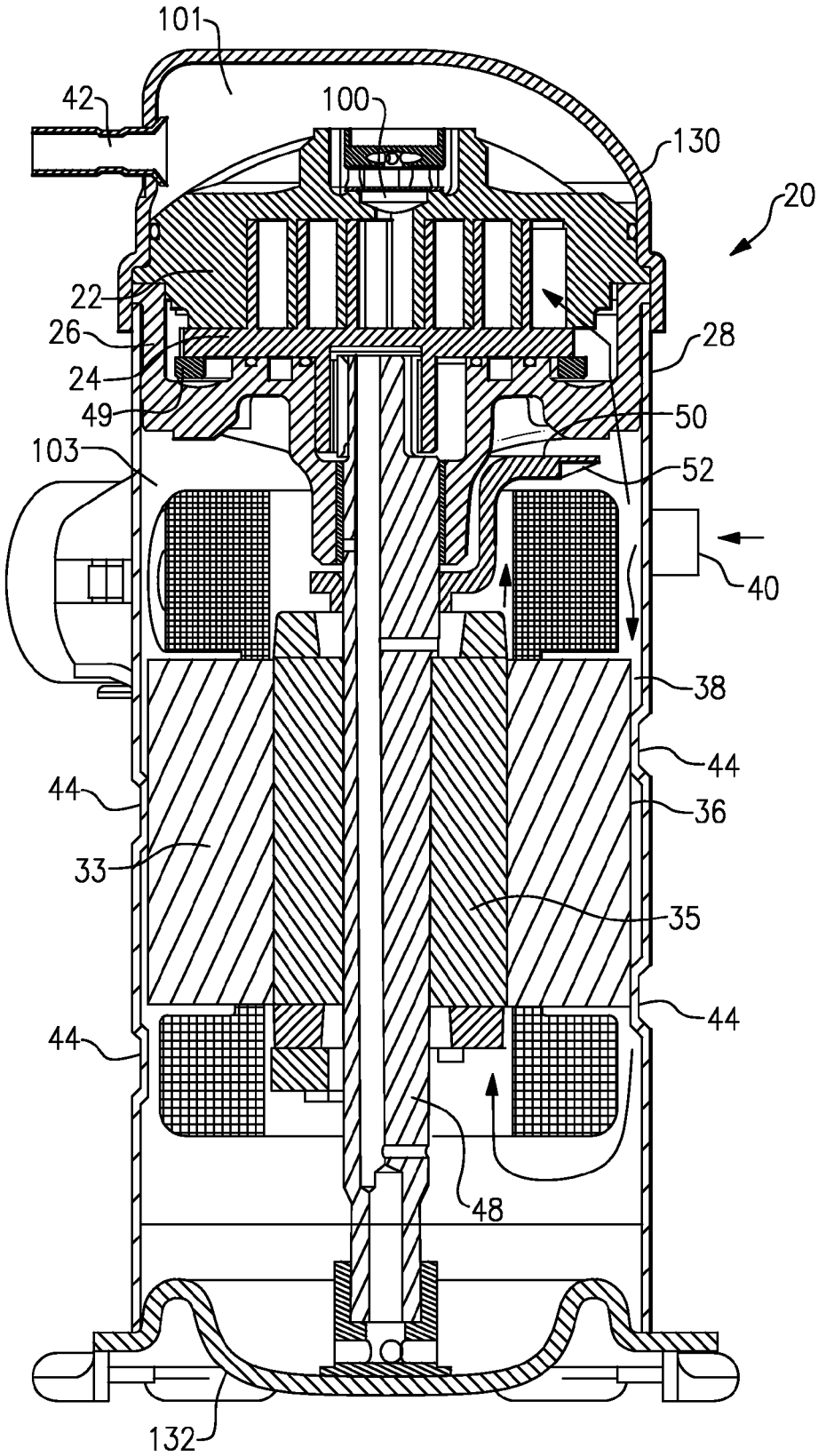
FIG. 1 is a schematic view of a first embodiment of this invention.

FIG. 1 illustrates a sealed compressor 20, which includes a scroll compressor pump unit having a non-orbiting scroll member 22, and an orbiting scroll member 24. Other types of compressor pump units can benefit from this invention. As known, generally spiral wraps on the two scroll members interfit to define compression chambers. A crankcase 26 mounts the orbiting scroll member 24. A driveshaft 48 causes the orbiting scroll member 24 to orbit relative to the non-orbiting scroll member 22, through a non-rotation coupling 49.

An electric motor 30 drives the rotating shaft 48. The electric motor 30 includes a rotor 35 and a stator 33. As mentioned above, in many modern compressor applications, the outer diameter of the compressor pump say, the crank case 26 and non-orbiting scroll member 22, for example, is larger than the outer diameter of the motor stator 33.

In operation, refrigerant enters the compressor 20 through a suction tube 40, and moves upwardly into the compression chambers. The refrigerant is compressed and moves to an outlet port 100, into a discharge plenum 101, and ultimately to a discharge port 42. That is, as is clear, the electric motor 30, and in particular stator 33, is mounted vertically beneath the compressor pump unit.

A housing provides hermetically sealed chambers, and also provides a seal between the discharge plenum 101, and a suction pressure plenum 103. The housing includes an upper end cap 130, a lower end cap 132, and a cylindrical shell 28 extending between the two end caps.

The cylindrical shell is formed with radially inwardly extending deformed portions 44. The deformed portions 44 are deformed inwardly, such that they will define an inner diameter, which is less than an outer diameter of the stator 33. The stator 33 can then be force-fit into the center shell 28, and the deformed portions 44 will lock on and hold the rotor 33 within the center shell 28 at a desired location. Further, there is a gap 38 between the outer diameter 36 of the rotor 33, and the inner diameter of the center shell 28 at locations other than the deformed portions 44. In this embodiment, the deformed portions 44 are generally formed along a spiral. The deformed portions 44 thus form a spiral path at the undeformed portions. Some suction refrigerant from suction tube 40 may pass downwardly and through the gap 38, and into the path, to pass along the outer periphery of the stator 33, and then move back upwardly between the rotor 35 and the stator 33 to cool the motor.

While a spiral path generally along a helix is specifically disclosed, other continuous path shapes may come within the scope of this invention. Essentially, the continuous path has a begin point spaced toward the compressor pump unit, and an end point spaced away, and the continuous path defines a flow path for the refrigerant through the gap defined the center shell and the stator.

In addition, a counterweight 50 is mounted to rotate with the driveshaft 48, and has an outer peripheral portion 52 which is configured to drive the refrigerant downwardly towards the space 38. The counterweight 50 has an outer peripheral extent which extends radially outwardly over the radially innermost portion of the stator 33. Details of this counterweight are disclosed in co-pending U.S. patent application Ser. No. 12/633,820, filed on even date herewith, and entitled "Scroll Compressor Counterweight With Cooling Flow Directing Surface."

Figure 2:
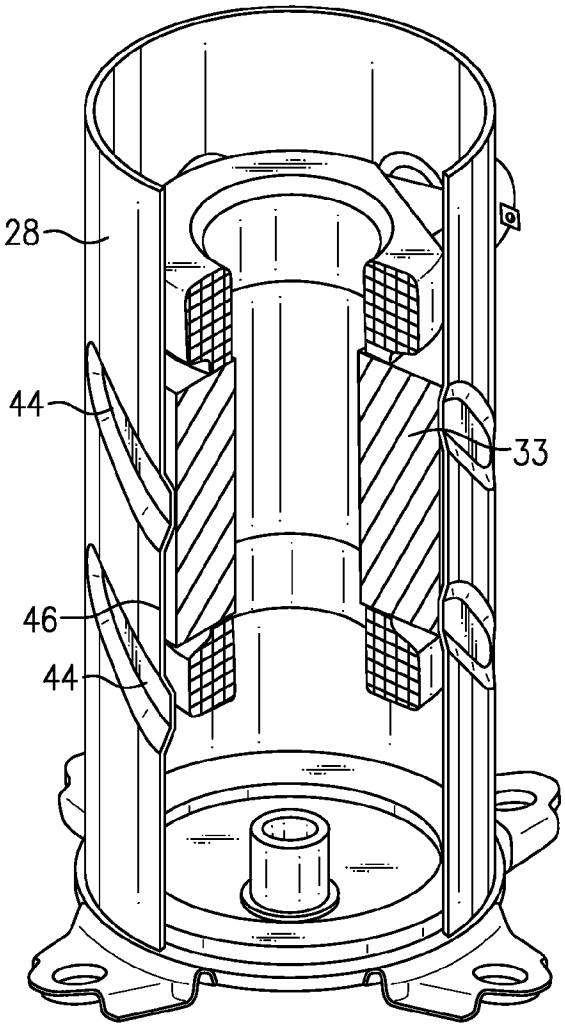
FIG. 2 is a cutaway view showing the motor and center shell of the first embodiment.

FIG. 2 shows the center shell 28 and the stator 33. As can be seen, the deformed portions 44 move in a spiral downwardly along the center shell 28. At the same time, the path 46 moves in a spiral direction to allow cooling fluid to be directed downwardly.

Figure 3:
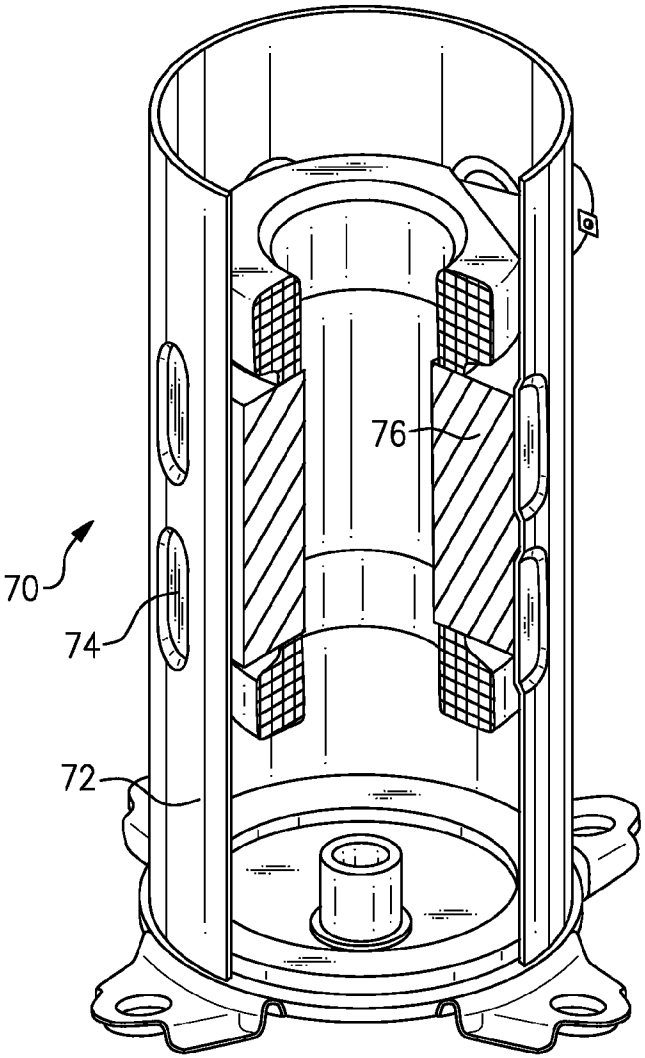
FIG. 3 shows a second embodiment.

FIG. 3 shows another embodiment 70 wherein deformed portions 7446 are deformed inwardly to contact the outer periphery of the stator 76. The center shell 7270 having the deformed portion 74 will have a great bulk of its inner surface area not deformed such that there will be flow passages for the cooling flow as in the FIGS. 1 and 2 embodiment. In this embodiment, as can be seen, there are discrete deformed portions 74 spaced both circumferentially and axially.

The disclosed invention thus provides a simple way of mounting a smaller diameter motor in a larger diameter center shell. Assembly is no more complex than the existing prior art wherein the center shell is sized to be equal to the outer diameter of the motor. In preferred embodiments, the surface area of the deformed portions is sufficient to secure the stator without any further required attachments (i.e., no adhesives, etc. required).

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A sealed compressor comprising:

a cylindrical shell extending along an axis;

a compressor pump unit mounted within said cylindrical shell;

an electric motor having an inner rotor and an outer stator, said stator having an outer peripheral surface of a first dimension, and said cylindrical shell having a nominal inner diameter, said nominal inner diameter being greater than said first dimension;

said rotor being associated with said electric motor to drive a driveshaft about said axis, said driveshaft being associated with said compressor pump unit to drive a pump element to compress a fluid;

a suction port extending through said cylindrical shell to deliver a suction fluid to be compressed by said compressor pump unit, and at least some of said suction fluid flowing into a gap defined between said nominal inner diameter of said center shell and said outer periphery of said stator; and said center shell having portions deformed radially inwardly to contact said outer periphery of said stator.

2. The sealed compressor as set forth in claim 1, wherein said compressor pump unit is a scroll compressor pump unit.

3. The sealed compressor as set forth in claim 1, wherein said deformed portions of said center shell extend in a continuous path from a begin point spaced toward said compressor pump unit, to an end point spaced away from said compressor pump unit.

4. The sealed compressor as set forth in claim 3, wherein said path is generally helical.

5. The sealed compressor as set forth in claim 1, wherein there are a plurality of discrete deformed portions.

6. The sealed compressor as set forth in claim 5, wherein said discrete deformed portions are spaced both about a circumference of said center shell, and axially along said center shell.

7. The sealed compressor as set forth in claim 1, wherein said deformed portions provide sufficient surface area to secure said stator without any further attachment structure.

8. The sealed compressor as set forth in claim 1, wherein said electric motor is mounted vertically beneath said compressor pump unit.

* * * * *